US009987667B1

(12) United States Patent
Lutoslawski et al.

(10) Patent No.: US 9,987,667 B1
(45) Date of Patent: Jun. 5, 2018

(54) ANTI-CAKING DEVICE

(71) Applicants: Jaroslaw Lutoslawski, Bradford (CA); Mark Christopher Lugowski, Scarborough (CA); Douglas Bruce Coyle, Aurora (CA)

(72) Inventors: Jaroslaw Lutoslawski, Bradford (CA); Mark Christopher Lugowski, Scarborough (CA); Douglas Bruce Coyle, Aurora (CA)

(73) Assignee: Torxx Kinetic Pulverizer Limited (BM)

( * ) Notice: Subject to any disclaimer, the term of this patent is extended or adjusted under 35 U.S.C. 154(b) by 0 days. days.

(21) Appl. No.: 15/406,274

(22) Filed: Jan. 13, 2017

Related U.S. Application Data

(60) Provisional application No. 62/278,024, filed on Jan. 13, 2016.

(51) Int. Cl.

| | |
|---|---|
| ***B08B 5/02*** | (2006.01) |
| ***B08B 13/00*** | (2006.01) |
| ***B08B 7/04*** | (2006.01) |
| ***B08B 3/02*** | (2006.01) |
| ***B08B 1/00*** | (2006.01) |

(52) U.S. Cl.
CPC ..... *B08B 7/04* (2013.01); *B08B 1/001* (2013.01); *B08B 3/02* (2013.01); *B08B 5/02* (2013.01); *B08B 13/00* (2013.01); *B08B 2220/01* (2013.01)

(58) Field of Classification Search
CPC .. B08B 7/04; B08B 3/02; B08B 13/00; B08B 1/001; A47L 9/04; A47L 9/0483; A47L 9/02; A47L 9/0441; A47L 5/30
See application file for complete search history.

(56) References Cited

U.S. PATENT DOCUMENTS

| | | | | |
|---|---|---|---|---|
| 3,987,970 | A * | 10/1976 | Burkett | B02C 13/18 241/154 |
| 5,551,909 | A * | 9/1996 | Bailey | B05B 3/02 451/102 |
| 2015/0082563 | A1* | 3/2015 | Semrau | F28G 7/00 15/104.07 |

* cited by examiner

*Primary Examiner* — Dung Van Nguyen
(74) *Attorney, Agent, or Firm* — Miller & Martin PLLC; Stephen J. Stark

(57) ABSTRACT

An anti-caking device has a plunger with a plunger head moveable between first and second positions. In the first position, the plunger head forms a surface with the housing, and in the second position, the plunger head is moved to provide at least a crack around its perimeter relative to the housing, whereby fluid proceeds from a fluid supply through the crack to assist in dislodging caked on material on the surface. Preferably, relatively low pressure fluid is utilized in many embodiments.

20 Claims, 4 Drawing Sheets

ANTI-CAKING DEVICE

CLAIM OF PRIORITY

This application claims the benefit of U.S. Provisional Patent Application No. 62/278,024 filed Jan. 13, 2016, which is included herein by reference in its entirety.

FIELD OF THE INVENTION

The present invention relates to a device for use in removing "caked on" or stuck material from surfaces and more preferably a device that is designed to direct fluid flow behind caked on material stuck to a surface such as a wall to mechanically push at least some of the material away from the wall with a piston while simultaneously directing fluid behind the piston face to least assist in having some of the material break away from the wall.

BACKGROUND OF THE INVENTION

Many industrial processes operate so that material can accumulate against surfaces. Vertically extending structures, such as walls, horizontally extending surfaces such as floor structures or even roof structures could have a tendency to accumulate material as the equipment is processing or moving material. Angled surfaces could experience similar issues.

One type of equipment for which a perceived need arose to remove such material is a structure similar to that shown in U.S. Pat. No. 3,987,970, incorporated herein by reference, for a pulverizing mill. Specifically, as the aims rotate and material is processed by that mill, it was discovered that, particularly in moist environments, that the walls of the drum could acquire "caked on" material which could ultimately decrease the performance of the mill, and eventually require the mill to be stopped, the material removed (such as by manually scraping and/or pressure washing) and then restarted.

Accordingly, the applicant determined that there was a need to remove caked on material from the vertically extending walls of that device, and then realized that there may be many other applications which might benefit from removing caked on material from other devices and/or surfaces.

SUMMARY OF THE INVENTION

Accordingly, it is an object of many embodiments of the present invention to provide at least one, if not a plurality of, anti-caking devices for use with equipment and/or surfaces subjected to material which may have a tendency to cake or stick to those surfaces, particularly over time, in an undesired manner.

It is another object of many embodiments of the present invention to provide an improved device or devices for preferably removing at least some accumulating material from surfaces possibly in an effort to improve the efficiency of the equipment.

Accordingly, in accordance with a presently preferred embodiment of the present invention, at least one, if not a plurality of, anti-caking device nozzles provide a moving piston which is normally closed or shut along a surface. The piston opens at least partially to permit or direct air or fluid flow between the surface and the deposited material.

Specifically, a moving piston can move outwardly slightly into a material deposit thereby providing a flow path for fluid to be directed between the wall and a portion of the deposit. This motion may also create a crack between the wall and the deposited matter so as to potentially increase the area where the fluid is acting. It may be possible for at least some embodiments to set the amount of piston travel between a fully open and a closed configuration and it is preferable that the piston be biased to the closed position so that the piston and/or housing can be substantially flush mounted relative to a surface of a machine wall or other equipment to which the device is connected.

The amount of bias to the shut position may be adjustable for at least some embodiments and the fluid pressure may be adjustable for some embodiments. Furthermore, various embodiments may use different kinds of fluid, some may use liquid, some may use air or other gas, and/or combinations thereof. Furthermore, the interval time of how much time the piston is at least partially open as well as the pressure of the fluid behind the piston can be controlled or possibly varied during the cycle. Upon stopping the air flow, the bias of the piston preferably shuts the piston to therefore prevent clogging of the air line internal to the nozzle.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENTS

Figure 1:
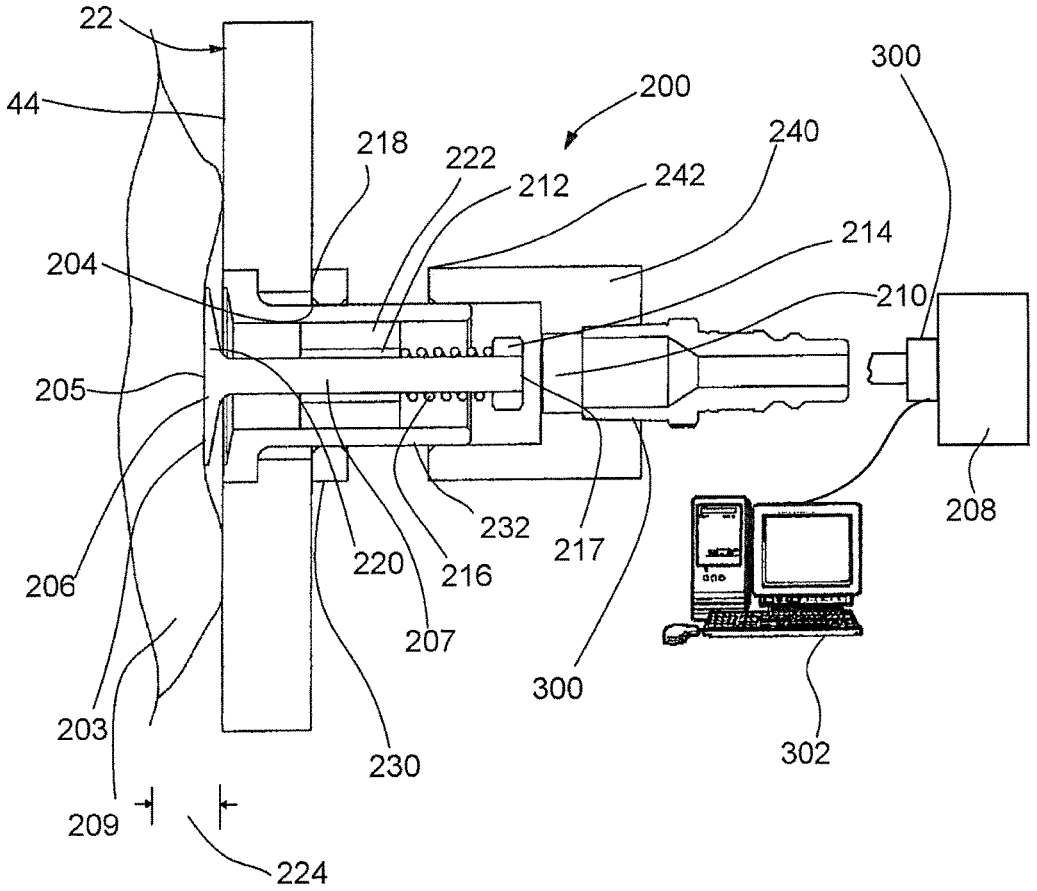
FIG. 1 is a cross section and schematic view of an anti-caking nozzle of the presently preferred embodiment of the present invention in an open configuration.
Figure 2:
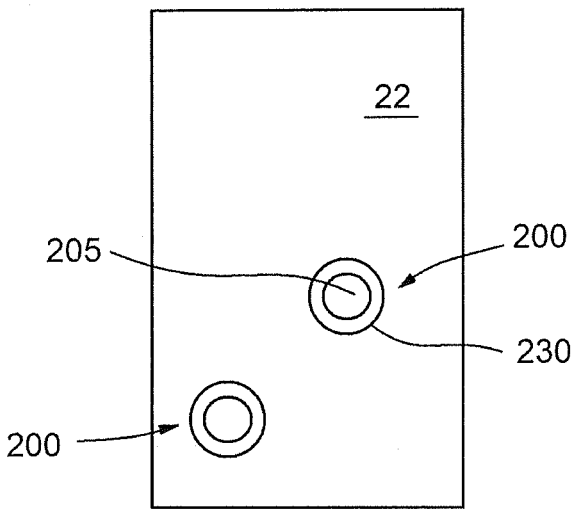
FIG. 2 is a front plan view of a wall showing two nozzles shown in FIG. 1.

FIG. 1 shows a cross sectional detail of an anti-caking device 200. The anti-caking device 200 has a piston illustrated as a plunger 203 which when in a first position has an upper surface 206 which is preferably flush with upper or outer surface 204 of casing 232. Inner surface 204 of casing 232 and/or lip 230, if utilized, preferably may be made to be at least substantially flush with interior surface 44 of the housing 22 or other horizontal, vertical, angled and/or other structure using one or more of the anti-caking devices 200. Upper or exterior surface 205 of plunger 203 may be at least substantially planar for many embodiments. In order to actuate the plunger 203, a supply of air or other fluid, if appropriate, from supply 208 is preferably selectively directed such as by a processor 302 opening a valve 300 or otherwise to direct fluid into inlet 210 which is then directed into bore 212 by passage 214 or otherwise so as to overcome bias of spring 216 to then not only outwardly move the plunger 203 to create one or more air passage 218, 220, (which for the illustrated embodiment would be a concentric ring directed at least partially radically outwardly relative to the plunger 203), but also physically moves the plunger 203 a distance 224 into a cavity of the housing 22 and therefore, depending on the air pressure of the air supply 208, this fluid movement could be done relatively slowly so that preferably chunks of material 209 extending away from plunger 203 can be relatively easily pushed into the cavity to be removed in a much better manner than other technologies.

For instance, if high pressure fluid (i.e., greater than 1000 psig) were utilized and the plunger 203 quickly punched through quickly, then a circular hole might be provided through the caked on material corresponding to the diameter of the exterior surface 205 of the plunger head 220. However, using a low pressure fluid such as air at about 10, 30 or 40 psi above the pressure in the housing 22, the plunger 203 can relatively slowly be pushed into the material and the air or other fluid then behind the pushing plunger head 220 can preferably direct a larger chunk of material 209 away from the interior surface 44 than just the perimeter of the upper or exterior surface 205 of the plunger head 220. Also with a chunk of material 209 removed, vortices internal to the pulverizer 10 and/or the fluid through the anti-caking device 200 can then assist in removing significantly more of a caked on material 209 with a chunk or portion of it removed.

Plunger head 220 could take on various configurations. Circular and planar is illustrated. Other shapes could be used with other embodiments.

Air or other pressure from fluid supply 208 can vary along with the tension of the bias spring 216 possibly along with an optimal amount of movement of the plunger 203 which might be limited by various limiters 222 or otherwise to prevent excessive outward travel so that the air through the air channels 218 may be provided in a particularly effective manner. Accordingly, for at least some embodiments, the distance of travel of the plunger head 220 can be varied or pre-selected (such as with adjustment screw 217 or otherwise) by various methods as are known in the art, the bias of the spring 216 (such as with an adjustment screw 217 or otherwise) could be varied or pre-selected as well.

Furthermore, the fluid pressure from supply 208 could also be varied to provide optimal conditions for removing caked on material under various environments. It may be that for some of the various embodiments that only a portion of these three variables might be variable with a control system and/or processor 302 controlling one or more valves 300 and/or other devices under certain conditions (i.e., 2 of 3) and/or some of them may be fixed by the manufacturer. It also may be that the time of application of fluid pressure may vary and/or be pre-selected for various embodiments. The fluid pressure in a given interval of operation could vary, such as beginning the cycle from 0 to 5 psig for 2 seconds, 5-10 psig for two seconds, then to 20 psig for two seconds, then to 40 psig for 10 seconds for a fully open configuration and then to 0 psig to the shut configuration. Other time sequences and/or pressure valves could be used with other embodiments.

Caked on material 209 could be any build up whether leftover waste in a pulverizer 10, wet or dry material, and/or possibly other materials in other systems. The waste material 209 removed preferably may have a larger cross sectional area than the plunger head 220 for many embodiments as the fluid pressure pushes more material 209 away from interior wall 44 then just off the plunger head 220.

Lip 230 of the casing 232 may extend about a perimeter of the piston or plunger head 220 for at least some embodiments. The casing 232 is preferably a stationary casing secured to the interior surface 44 such as of a housing 22 or other structure. There are various ways of securing the casing 232 to the surface 44 such as by recessing surface 44 to receive lip 230 so as to provide it at least substantially flush, if not flush mounting on the interior surface 44 where the plunger 203 operates, but also a nut 240 may be utilized to assist on an external surface such as against an external surface 242 so as to provide a stationary construction.

The piston or plunger 203 preferably moves mechanically from a closed configuration in which clogging of the airline as provided through the inlet 210 is prevented by the closed configuration. The plunger 203 then moves into the caked on material 209 to preferably create a crack and/or some separation between the wall 44 and the deposit material 209 preferably in an effort to increase the area where the compressed air or other fluid from the supply 208 can act upon the material 209.

Figure 3:
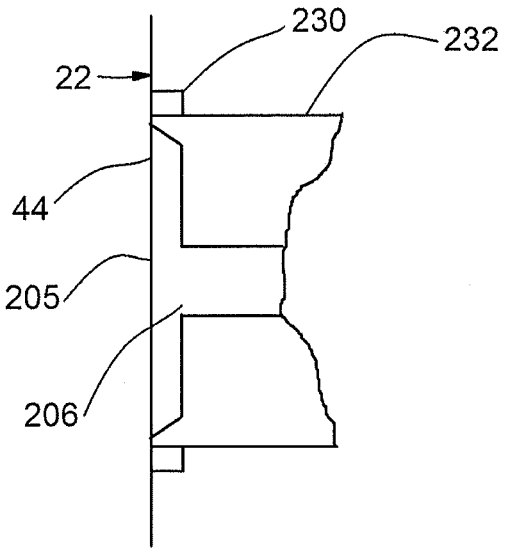
FIG. 3 is a cross section view of the nozzle of FIG. 1 in a closed configuration.
Figure 4:
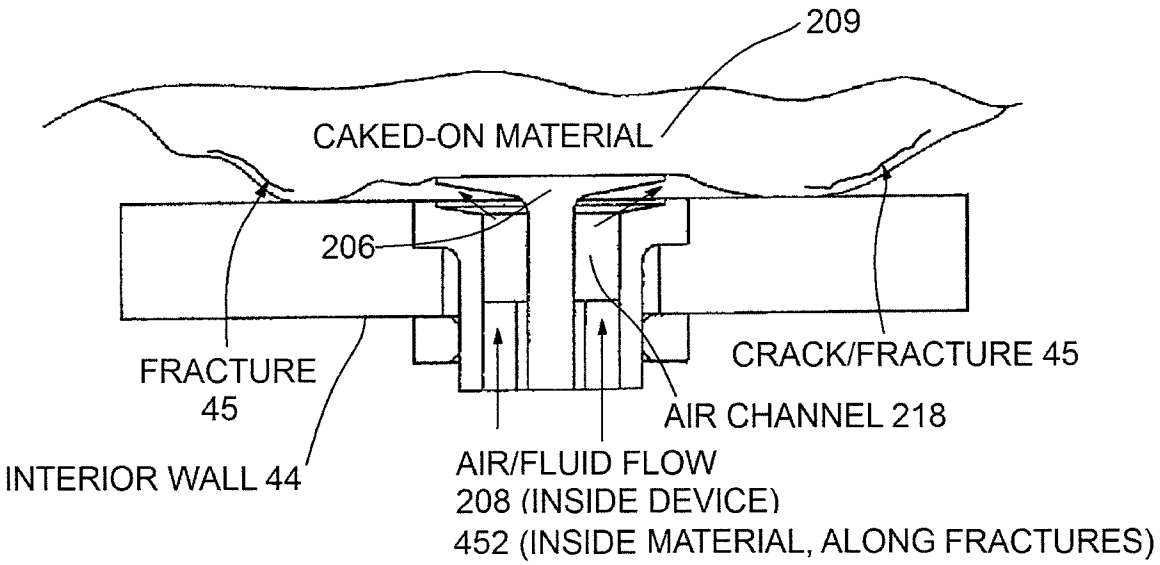
FIG. 4 is a cross-section view similar to FIG. 1, showing the removal of caked on material, in operation.
Figure 5:
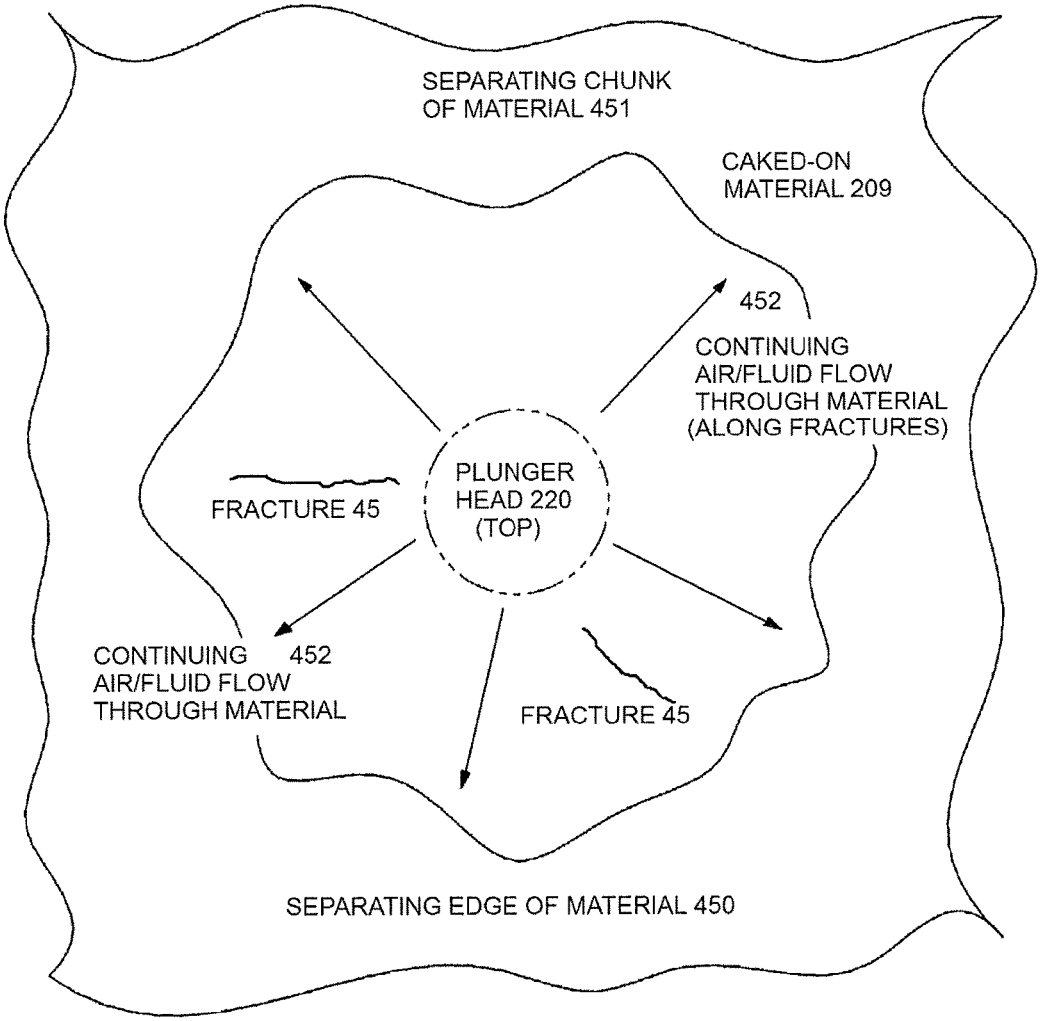
FIG. 5 is a front plain view similar to FIG. 2 in operation.

When the air supply 208 secures applying air through the inlet 210 the bias and spring 207 can return the plunger 203 to the shut position as shown in FIG. 3.

For some embodiments it may be possible that the plunger 203 moves just slightly at the beginning of its process so as to crack the material 209 as to slightly move the material 209 away from the wall 44 near the piston or plunger 203 in order for the amount of material 209 removed to be greater than the perimeter of the exterior surface 205 of the plunger 203. As the pressure builds up between the material 209 and the wall 44 anticipate that a larger portion of material 209 will be removed than just from the perimeter of the exterior surface 205 of the plunger head 220 such as could occur with the rapid deployment of the plunger 203 into the caked on material 209.

In addition to air, other gasses may be utilized, as well as and/or in addition to other fluids such as liquids which may assist in removing the caked on material 209 which could occur from a variety of processes.

As discussed above, caked on material could include material within a pulverizer which could be dry and/or wet material such as from various treated material. Other equipment may be subjected to other materials which may have a tendency to cake on or otherwise accumulate on surfaces such as surface 22 to which the equipment operator may not desire accumulated material and/or that the anti-caking devices 200 may assist in removing such material 209 so as to reduce the workload of manual scraper and/or pressure washing.

An anti-caking device 200 of at least some embodiments may comprise a plunger 203 having a plunger head 220 with an upper or exterior surface 205, said plunger 203 movable intermediate first and second positions, a housing 22 having a surface, such as interior surface 44 or other surface, cooperating with the upper or exterior surface 205 of the plunger head 220 to form an outer surface 205 with the plunger 203 in the first position, and a fluid supply in communication through a casing 232 with the plunger 203.

The plunger 203 may be movable to the second position from the first position thereby outwardly displacing the plunger head 220 away from the surface 44 of the housing 22 to provide at least a gap 218, and when in the second position, a fluid is directed from the fluid supply 208 through the casing 232 and out of the at least a crack 218 thereby assisting in removing caked on material 209. It may be that the application of fluid under pressure, such as about 40 psig or less from the fluid supply 208 moves the plunger 203 from the first to the second position, and/or other equipment is utilized to move the plunger 203. The plunger 203 may be spring biased to return to the first position if not otherwise returned to the first position after applying fluid, such as air or other fluid, to the material 209.

The plunger head 220 may be flush with the surface 44 of the housing 22 when in the first position. Fluid may be provided at a preselected pressure and/or utilize a control system having a processor 302 controlling varying the pressure of the fluid with the plunger 203 in the second position and/or valve position(s) of the valve(s) 300, such as open or closed. In many embodiments, a layer of accumulated material 209 on the outer or exterior surface 205 over the plunger head 220 and the fluid displaces a portion of the layer of accumulated material 209 having a larger area than the area of the plunger head 220 when in the second position.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An anti-caking device comprising:

a plunger having a plunger head with an upper surface, said plunger movable intermediate first and second positions;

a housing having a surface cooperating with the upper surface of the plunger head to form an outer surface with the plunger in the first position;

a fluid supply in communication through a casing with the plunger;

wherein the plunger is movable to the second position thereby outwardly displacing the plunger head away from the surface of the housing to provide at least a gap, and when in the second position, a fluid is directed from the fluid supply through the casing and out of the at least a crack thereby assisting in removing caked on material.

2. The anti-caking device of claim 1 wherein the plunger head is flush with the surface of the housing when in the first position.

3. The anti-caking device of claim 1 wherein the plunger is spring biased to return to the first position.

4. The anti-caking device of claim 1 wherein the fluid supply provides the fluid under pressure to move the plunger to the second position.

5. The anti-caking device of claim 1 wherein the fluid is air.

6. The anti-caking device of claim 1 wherein the fluid is provided through the at least a crack at no more than about 40 psig.

7. The anti-caking device of claim 1 wherein the fluid is provided at a preselected pressure.

8. The anti-caking device of claim 1 further comprising a control system controlling varying the pressure of the fluid with the plunger in the second position.

9. The anti-caking device of claim 8 wherein the control system further comprises a processor and at least one valve with the processor at least assisting in opening the valve.

10. The anti-caking device of claim 1 further comprising a layer of accumulated material on the outer surface over the plunger head and the fluid displaces a portion of the layer of accumulated material having a larger area than the area of the plunger head when in the second position.

11. An anti-caking device comprising:

a plunger having a plunger head with an upper surface, said plunger movable intermediate first and second positions;

a housing having a surface cooperating with the upper surface of the plunger head to form an outer surface with the plunger in the first position;

a fluid supply in communication through a casing with the plunger;

wherein the plunger is movable to the second position thereby outwardly displacing the plunger head away from the surface of the housing to provide at least a gap with the application of fluid from the fluid supply whereby the fluid proceeds out of the at least a crack thereby assisting in removing caked on material.

12. The anti-caking device of claim 1 wherein the plunger head is flush with the surface of the housing when in the first position.

13. The anti-caking device of claim 1 wherein the plunger is spring biased to return to the first position.

14. The anti-caking device of claim 1 wherein the fluid supply provides the fluid under pressure to move the plunger to the second position.

15. The anti-caking device of claim 1 wherein the fluid is housing is a wall of a pulverizer.

16. The anti-caking device of claim 1 wherein the fluid is provided through the at least a crack at no more than about 40 psig.

17. The anti-caking device of claim 1 wherein the fluid is provided at a preselected pressure.

18. The anti-caking device of claim 1 further comprising a control system controlling varying the pressure of the fluid with the plunger in the second position.

19. The anti-caking device of claim 18 wherein the control system further comprises a processor and at least one valve with the processor at least assisting in opening the valve.

20. The anti-caking device of claim 1 further comprising a layer of accumulated material on the outer surface over the plunger head and the fluid displaces a portion of the layer of accumulated material having a larger area than the area of the plunger head when in the second position.

* * * * *